United States Patent [19]

Fritsch et al.

[11] Patent Number: 4,760,220

[45] Date of Patent: Jul. 26, 1988

[54] OPERATOR MECHANISM HAVING REDUCED HANDLE THROW AND IMPROVED HANDLE LOCK

[75] Inventors: Ronald J. Fritsch, Sussex; Francis A. Lubinski, Milwaukee, both of Wis.

[73] Assignee: Eaton Corporation, Cleveland, Ohio

[21] Appl. No.: 66,571

[22] Filed: Jun. 26, 1987

[51] Int. Cl.[4] ..... H01H 9/20

[52] U.S. Cl. ..... 200/50 A; 200/302.1; 200/330

[58] Field of Search ..... 200/17 R, 18, 50 A, 200/50 AA, 153 G, 153 H, 330, 331, 337, 302.1; 361/337, 339, 343, 344

[56] References Cited

U.S. PATENT DOCUMENTS

| | | | |
|---|---|---|---|
| 2,956,133 | 10/1960 | Middendorf | 200/50 A X |
| 3,272,953 | 9/1966 | Tillson | 200/330 |
| 3,301,972 | 1/1967 | Brumfield | 200/17 R |
| 3,311,720 | 3/1967 | Johnson | 200/50 A |
| 3,365,555 | 1/1968 | Ponsy | 200/18 X |
| 3,384,722 | 5/1968 | Hanke et al. | 200/50 A |
| 3,978,304 | 8/1976 | Salvati et al. | 200/50 A X |
| 4,027,361 | 6/1977 | Yoneya | 24/385 |
| 4,034,169 | 7/1977 | Armstrong et al. | 200/50 A |
| 4,074,091 | 2/1978 | Bischof et al. | 200/50 A |

OTHER PUBLICATIONS

Two Page Brochure, "Engineer's Guide for Sealing System Design", Schlegel Corp., 1986.

*Primary Examiner*—J. R. Scott

*Attorney, Agent, or Firm*—L. G. Vande Zande

[57] ABSTRACT

A handle (52) is guided for linear sliding movement within a housing (38) mounted to the front of a removable control unit (16) and has a hinged connection (52c,64) with the forward end of a drive lever (60) which is pivotally mounted (62) within the control unit and linked (68,72) to circuit interrupting apparatus (26) mounted in the control unit for reducing the handle throw necessary to operate the apparatus. A slide bar (84) is spring biased (86) to an extended position with the operator in the ON position to engage a fixed structure (92) of the cabinet to prevent withdrawal or insertion of the control unit when the apparatus is in an ON condition. The slide bar is driven to a retracted position by the handle (52d,88) when moved to the OFF position. A handle locking plate (94) is lockable in a position of interference with the handle to prevent movement from OFF to ON positions, and has a breakaway tab (94f) removable to permit locking the handle against movement from ON to OFF. A second breakaway tab (94g) on the locking plate is removable to accommodate different OFF positions of the handle for different types of circuit interrupting apparatus.

28 Claims, 6 Drawing Sheets

OPERATOR MECHANISM HAVING REDUCED HANDLE THROW AND IMPROVED HANDLE LOCK

CROSS REFERENCE TO RELATED APPLICATIONS

This Application is related to copending applications entitled "Latch For a Removable Control Unit of a Motor Control Center", Ser. No. 066,572 filed June 26, 1987 in the name of Ronald J. Fritsch and "Plug-in Connector Module For a Removable Control Unit of a Motor Control Center", Ser. No. 066,573 filed June 26, 1987 in the name of Ronald J. Fritsch and Allan E. Grams, each assigned to the assignee of this application.

BACKGROUND OF THE INVENTION

This invention relates to motor control centers having compartmentalized cabinets for receiving removable control units which are inserted or withdrawn through open fronts of the respective compartments. More particularly, this invention relates to an operator mechanism which is accessible to the exterior of the cabinet for operating circuit interrupting apparatus mounted on a respective removable control unit disposed within the cabinet.

Motor control centers comprise a cabinet having a plurality of vertically arranged compartments which open to a forward face of the cabinet. The individual compartments may be of varying height, and each comprise a door individual to the respective compartment for closing off the same. Removable motor control units are insertably received individually within the respective compartments from the open front thereof, such units having motor control apparatus comprising circuit interrupting apparatus such as circuit breakers or fusible disconnect switches mounted therein. Such circuit interrupting apparatus has its own operator mechanism, but auxiliary operating mechanisms are provided on the control unit which enable the apparatus to be operated from the exterior of the motor control center cabinet. These auxiliary operator mechanisms are commonly mounted at the forward edge of the control unit and are accessible exteriorly of the cabinet through openings provided in the respective door of the cabinet. A requirement of motor control center design is that the uppermost position of the handle for the auxiliary operator mechanism for the uppermost compartment be no more than a certain maximum height as measured from the floor to permit operation thereof by a workman of average height without need for a ladder, step or hook device. Accordingly, this requirement places certain restrictions on the design and operation of the auxiliary operator mechanism with respect to handle throw.

Another factor to be considered in the design of auxiliary operator mechanisms is non-interference of the operator handle with the opening in the door when the door is swung to its open position. The width of the opening is determined by the forwardmost position of the operator handle with respect to the arc defined by the door. The vertical dimensions of the opening are determined by the uppermost and lowermost positions of the operator handle. Since the auxiliary operator mechanism is mounted on the front of the control unit, it is desirable that the frontal dimensions be as small as possible to minimize any access restriction to the panel space of the control unit behind the mechanism. However, it is necessary that the housing of the auxiliary operating mechanism be wide enough to fill the opening in the door to provide proper sealing for the control center.

Another concern in providing an auxiliary operator mechanism for motor control centers is a requirement that the operator mechanism have provisions for locking the operator handle in the OFF or ON position. The operator mechanism should be capable of locking the handle in the OFF position with as many as three padlocks whereby maintenance personnel may operate the respective motor control unit to its OFF condition and lock the handle in that position with a personal padlock or similar locking device to enable work to be performed on equipment controlled by that unit with the assurance that power cannot inadvertently be restored by another individual operating the mechanism to an ON condition. It is occasionally desirable to enable the handle to be locked in the ON position, although this locking feature commonly requires the maintenance worker to make some conscious modification of the operator mechanism in order to accomplish locking in the ON position.

SUMMARY OF THE INVENTION

This invention provides an auxiliary operator mechanism for circuit interrupting apparatus of a motor control center wherein the auxiliary operator handle has a minimal throw for accomplishing operation of the circuit interrupting apparatus within the control unit. The auxiliary operating mechanism comprises linkage pivotally mounted within the control unit and connected with the operator of the respective circuit interrupter apparatus so as to provide a preferred pivotal operating motion for that apparatus. The external handle of the auxiliary operator mechanism is mounted for linear sliding movement and is hinged to the internal linkage at a point remote from the pivot of that linkage to effect a driving connection therebetween. The handle is disposed in a fixed attitude projecting perpendicularly to the direction of sliding movement, thereby reducing the vertical throw of the handle and providing a uniform, minimum forwardmost projection of the operator handle with respect to that which would occur if the handle was a fixed extension of the pivoted linkage.

A handle locking plate is biased to a normally retracted position within a housing of the auxiliary operating mechanism, the locking plate being extendable to interfere with handle movement when the handle is in an OFF position corresponding to an OFF condition of the circuit interrupting apparatus. A breakaway tab on the locking plate abuts the operator handle when the latter is in the ON position to prevent the locking plate from being extended to an interfering position with the handle when in the ON position unless the breakaway tab is first removed by a workman. This invention further provides an improved seal for surrounding the auxiliary operator handle to deter foreign objects from entering the motor control center cabinet through an opening for the handle, and an interlock for the removable control unit which engages with a fixed portion of the cabinet to prevent withdrawal of the removable control unit when the apparatus is in an ON condition, the interlock being driven directly by the auxiliary operator mechanism to a releasing position when the operator handle is moved to an OFF position.

The invention and its advantages will be more readily apparent when reading the following description and claims in conjunction with the accompanying drawings.

DESCRIPTION OF THE PREFERRED EMBODIMENT

Figure 2:
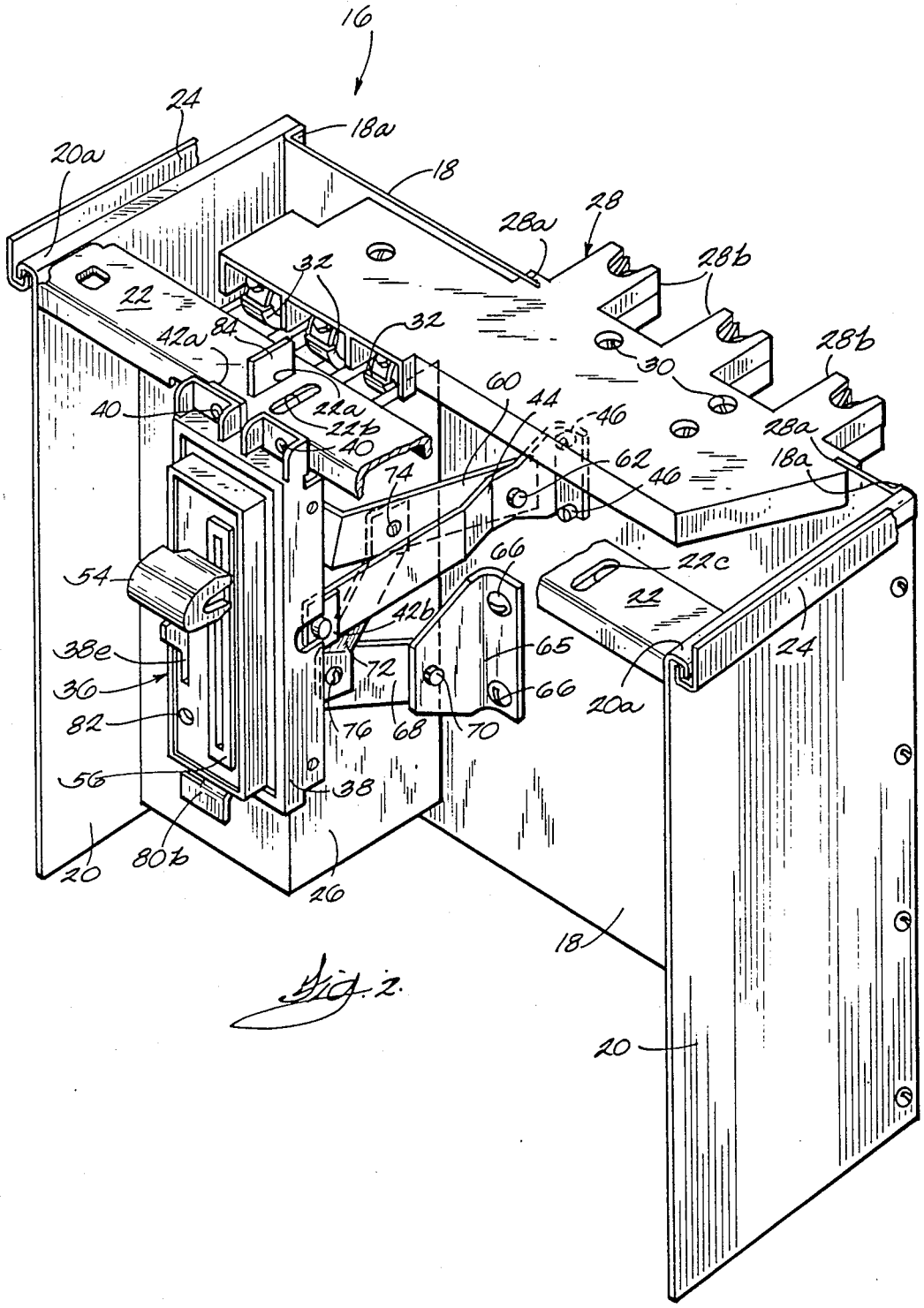
FIG. 2 is a perspective view of a removable control unit showing the auxiliary operator mechanism of this invention mounted thereon.
Figure 1:
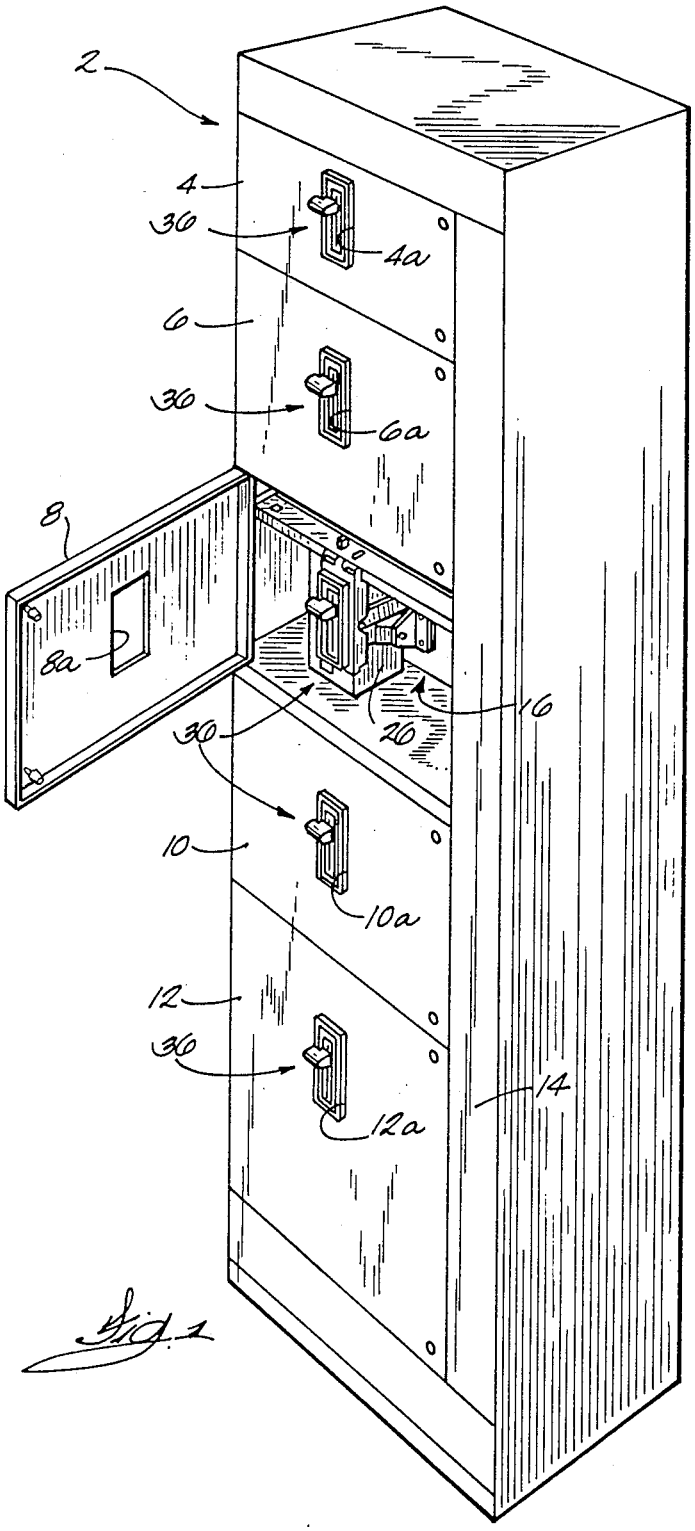
FIG. 1 is a perspective view of a motor control center having a plurality of removable control units on which the auxiliary operator mechanism of this invention is mounted.

A motor control center 2 is shown in FIG. 1. The motor control center comprises a sheet metal cabinet having a plurality of vertically arranged compartments open to the front of the cabinet and closed by respective doors 4, 6, 8, 10 and 12 which are hinged to the cabinet along their respective left-hand edges. A narrow door 14 is disposed to the right of the compartments and is hinged along its right-hand edge to the cabinet. Door 14, when opened, exposes a wiring compartment within the cabinet. Each compartment has a removable control unit 16 slidably mounted therein through the open front when the respective door is open. With reference also to FIG. 2, a removable control unit 16 comprises a rear panel 18 having rearwardly turned flanges 18*a* formed at the lateral edges thereof and a pair of side panels 20 which are attached to the respective flanges 18*a* by suitable means. An inverted U-shaped channel 22 having downwardly turned flanges (not shown) at its opposite ends is secured between the side panels 20 at the upper forward ends thereof to provide forward bracing and stability for the control unit 16. Each of the side panels 20 of the control unit have formed flanges 20*a* which project outwardly and downwardly along the upper edge thereof. The flanges 20*a* are slidably received within fixed guides 24 in the cabinet for permitting the control unit 16 to be slidably inserted or withdrawn from the respective compartment. Reference may be had to the aforementioned copending application Ser. No. 006,572 filed June 26, 1987 entitled "Latch For a Removable Control unit of a Motor Control Center" for a more complete description of the guides 24 and the method of slidably mounting control unit 16 to the cabinet.

A molded case circuit breaker 26 is attached to rear panel 18 by screws (not shown) or the like, the circuit breaker 26 providing an exemplary embodiment of circuit interrupting apparatus. Also mounted on the rear panel 18 is a connector module 28 having slots 28*a* receiving lateral upright edges of a cutout in the upper edge of rear panel 18. A pair of screws 30 are received within suitable openings in connector module 28 and threadably engage aligned holes in a turned-over shelf 18*b* (FIG. 4) of rear panel 18 for securing the connector module 28 to the rear panel 18. A plurality of preformed connector straps 32 are attached between terminals of the connector module and terminals of the circuit breaker 26. The rear surface of connector module 28 is provided with a plurality of rectangular projecting shrouds 28*b* which contain stab-on connectors for electrical attachment with vertically oriented bus bars (not shown) within the motor control center cabinet. Reference may be had to the aforementioned copending application Ser. No. 066,573 filed June 26, 1987 entitled "Plug-in Connector Module For a Removable Control Unit of a Motor Control Center" for a more complete description of the arrangement of the plug-in connector module 28, and its connections with the circuit interrupting apparatus and the motor control center vertical bus bars.

Figure 4:
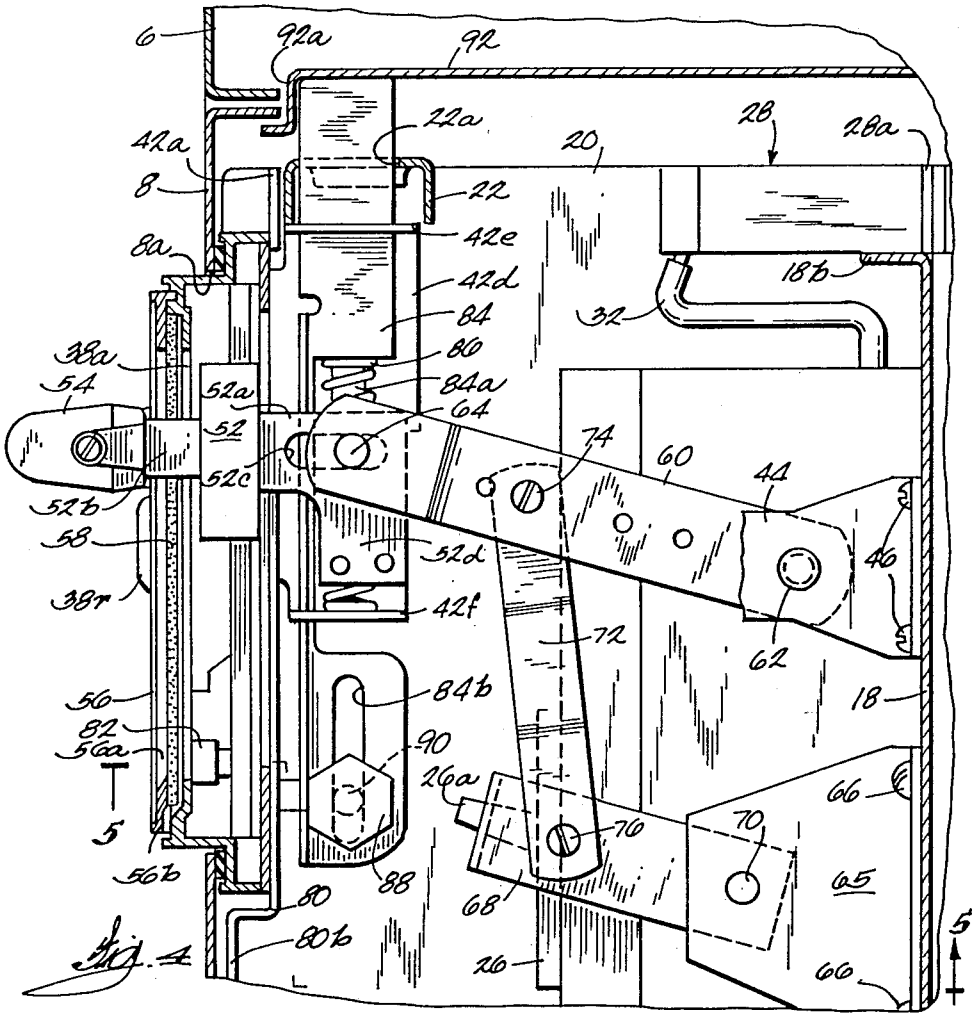
FIG. 4 is a cross-sectional view of the auxiliary operator mechanism of this invention and fragmentary portions of the removable control unit and motor control center cabinet associated therewith, the view being taken along line 4—4 in FIG. 3.
Figure 3:
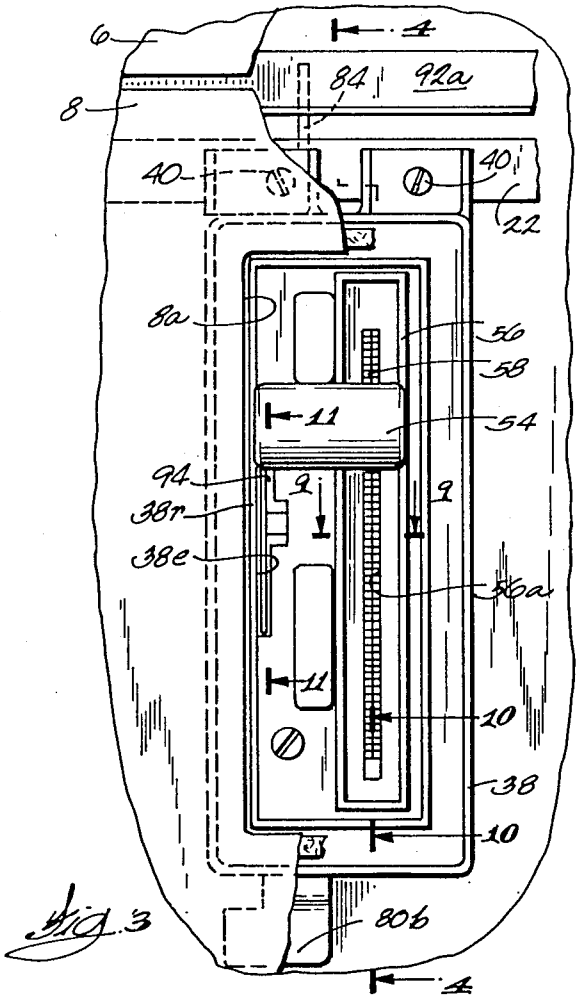
FIG. 3 is a front view of the auxiliary operator mechanism of this invention.

The auxiliary operator mechanism 36 of this invention comprises a molded housing 38 which is attached at its upper end to the U-shaped channel 22 by a pair of screws 40. Operator mechanism 36 also comprises a lower support plate 42 (see FIG. 5) attached to the rear of housing 38. Support plate 42 has a tab 42*a* projecting from the upper end thereof which is disposed between channel 22 and housing 38 when the housing is attached to the channel by one of the screws 40. A second tab 42*b* extends rearwardly along the right-hand side of operator mechanism 36 as viewed in FIG. 2, the tab 42*b* having a hole formed therein. A brace 44 is attached to rear panel 18 by a pair of screws 46, the brace extending forwardly to overlap tab 42*b*. A hole is provided in the end of brace 44 which aligns with the hole in tab 42*b* and the two members are secured together by a rivet which passes through the aligned openings. The doors 4–12 of the cabinet are provided with openings 4*a*–12*a* through which a forwardly extending portion of housing 38 projects when the respective doors are closed to provide exterior accessibility of the operator mechanism with respect to the cabinet as seen in FIGS. 1, 3 and 4.

Figure 5:
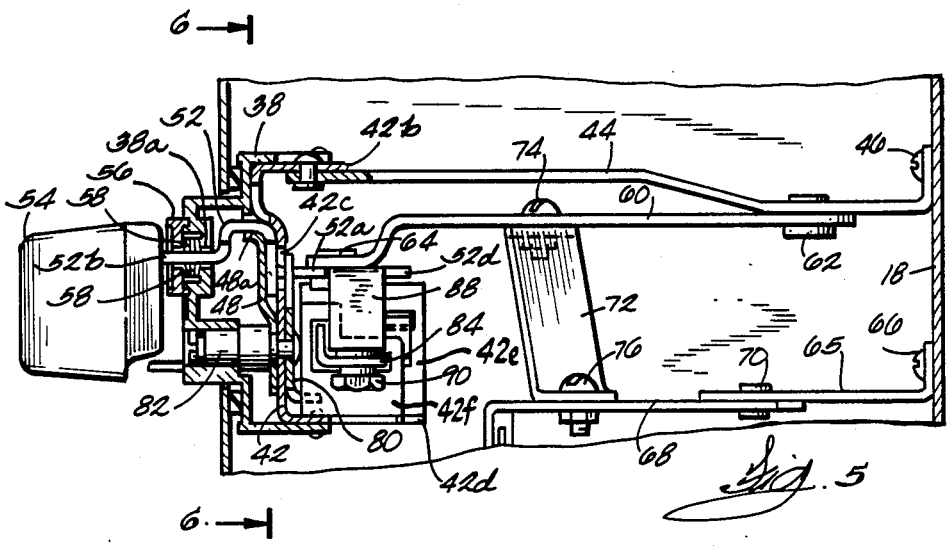
FIG. 5 is a cross-sectional view of the auxiliary operator mechanism of this invention taken generally along the line 5—5 in FIG. 4.

A guide plate 48 is attached to the forward surface of support plate 42 by a pair of rivets 50 (FIG. 6), the guide plate 48 being offset along its length to provide a space between it and the support plate 42 (FIG. 5). The lateral edge of the offset portion of guide plate 48 is formed over as a longitudinal flange 48*a* (FIG. 5) which extends forwardly. An operator handle bracket 52 is disposed in the space between support bracket 42 and guide plate 48 as seen best in FIG. 5, the bracket having a rearwardly extending drive leg 52*a* which projects through a slot 42*c* in support bracket 42. A forwardly extending leg 52*b* of bracket 52 projects through an elongated slot 38*a* of housing 38 and has an operator knob 54 attached to the outermost end thereof. The handle bracket 52 is guided for linear sliding movement between the support plate 42 and guide plate 48 with leg 52*b* extending perpendicularly to the linear movement.

Figure 8:
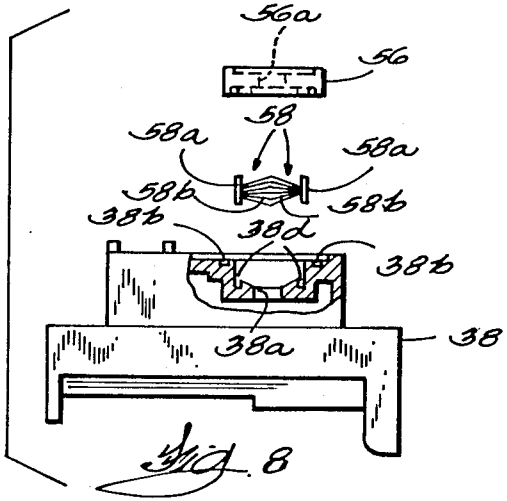
FIG. 8 is an elevational exploded view, partially in cross-section, of a housing, seal and cover of the auxiliary operating mechanism of this invention.
Figure 7:
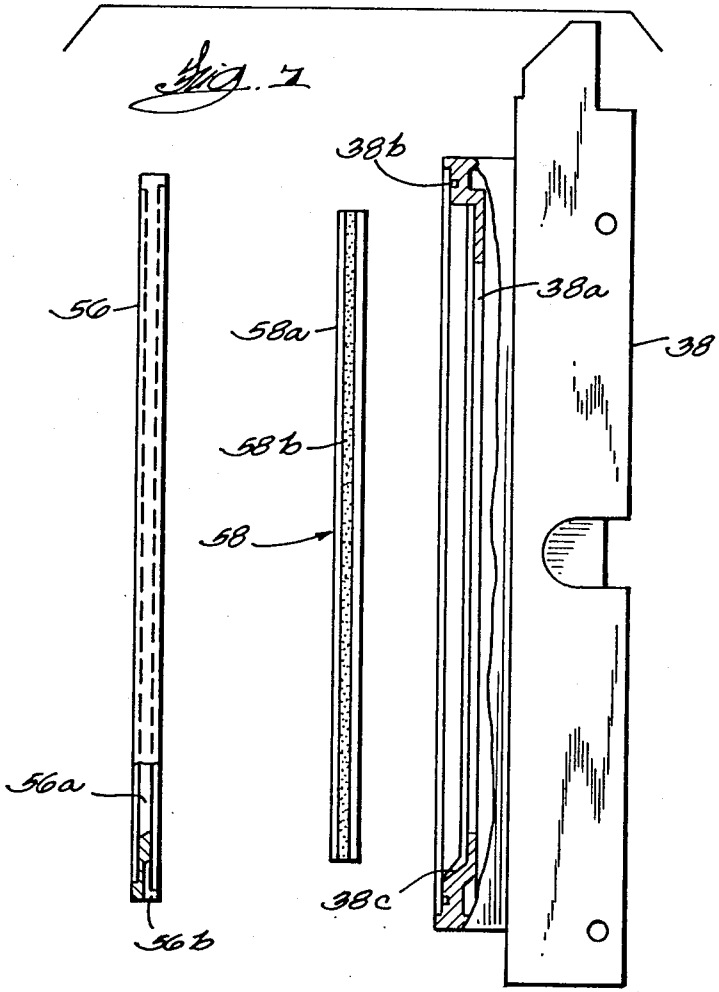
FIG. 7 is a side elevational exploded view, partially in cross-section of a housing, seal and cover of the auxiliary operating mechanism of this invention.

A seal is provided for handle leg 52*b* of bracket 52 within the housing 38. Elongated slot 38*a* is formed in the front or escutcheon portion of housing 38. Referring particularly to FIGS. 7–10, a cover 56 is adapted to be secured to the front face of housing 38 to overlie the slot 38*a*, the cover having a slot 56*a* which is substantially coextensive with slot 38*a*. The side walls of cover 56 extend rearwardly to define a rectangular skirt which is received in a complementally formed rectangular groove 38*b* in the front surface of housing 38. As seen in FIGS. 4 and 7, a passageway 56*b* is formed in the lower wall of cover 56 at the center of that wall and the groove 38*b* is interrupted in that area. The lower internal wall of housing 38 is beveled outwardly at 38*c* to align with the passageway 56*b* for reasons that will be explained later. It may also be noted that the lower edge of slot 56*a* is also beveled outwardly. A pair of fibrous weatherstrip type sealing members 58 are disposed along the vertical edges of the aligned slots 38*a* and 56*a*. Each sealing member 58 comprises a base or spine portion 58*a* of plastic or plasticized fabric and a plurality of outwardly extending fibers 58*b* arranged in a brush-like manner. The fibers 58*b* are disposed over the entire length of the base 58*a* and, as seen in FIG. 8, diverge outwardly at the free ends thereof. Housing 38 is provided with grooves 38*d* spaced along opposite edges of slot 38*a* for receiving an edge of the base portion 58*a* of the respective sealing members to position that member along the slot. The surfaces between slot 38*a* and grooves 38*d* are beveled at an angle less than the divergent angle of the fibers in their natural condition to provide a small amount of restraint on the divergence of the fibers. Cover 56 similarly has beveled surfaces 56*c* adjacent opposite vertical edges of slot 56*a*. Vertical surfaces 56*d* are provided at the rear of cover 56 outboard of the beveled surfaces 56*c*. The base portions of respective sealing members 58 abut against surfaces 56*d* to position the forward edges of the sealing members. The sealing members 58 are positioned in the housing 38 with their base portions in grooves 38*d*. The spacing of grooves 38*d* is such that the free ends of the fibers of the opposed sealing members 58 intermesh along the vertical center of the slots 38*a* and 56*a*. The cover 56 is then positioned to the front surface of housing 38 such that the rearwardly projecting skirt of the sidewalls is received within groove 38*b*. As mentioned above, vertical surfaces 56*d* position the forward edges of the base portions of sealing members 58. The cover 56 is attached to housing 38 by any suitable bonding method, preferrably ultrasonic welding. The leg 52*b* of handle bracket extends forwardly through the aligned slots 38*a* and 56*a* and through the centrally disposed slit formed by the intermeshing fibers 58*b*. As the handle bracket leg 52*b* moves along this slit, it forces the fibers apart along its leading edge, but the natural resilience of the fibers 58*b* causes them to intermesh again immediately along the trailing edge of leg 52*b*. The fibers 58*b* are particularly effective in sealing the housing assembly against dust. However, by providing a drainage passageway and beveled lower edges of the slots 38*a* and 56*a*, the fibers also form an effective moisture seal. The intermeshing and flexing action of the fibers unsettles any moisture collecting thereon, and gravity moves the moisture toward the bottom of the housing assembly where it drains through the passageway 56*b*.

A drive lever 60 is pivotally mounted on the brace 44 at the base thereof by a shouldered rivet 62. The forward extending end of drive lever 60 is offset from the normal plane of lever 60 to be disposed in surface-to-surface engagement with drive leg 52*a* of handle bracket 52. Drive leg 52*a* has a slot 52*c* (FIG. 4) therein which is elongated in a direction perpendicular to the direction of linear sliding movement of the bracket 52. A rivet 64 extends through a hole of drive lever 60 and through the slot 52*c* to form a hinged connection between drive lever 60 and drive leg 52*a*. Thus, as the handle bracket 52 is slid linearly reciprocably within the space between support plate 42 and guide plate 48, the drive lever 60 is pivoted about the rivet 62 by the hinge connection provided by rivet 64, the latter translating forward and rearward within the elongated slot 52*c* as the drive lever 60 moves over center of the pivot 62. A bracket 65 is mounted to rear panel 18 of the removable control unit by a pair of screws 66. Not shown in the drawings, a similar bracket may be mounted at the opposite side of the circuit breaker 26. A U-shaped yoke 68 is pivotally mounted between the support brackets 65 by rivets 70. The bite portion of yoke 68 has an opening therein which surrounds an operating handle 26*a* of circuit breaker 26. A link member 72 is pivotally connected to drive lever 60 by a shouldered screw 74 and to yoke 68 by a shouldered screw 76. Thus, pivotal movement of drive lever 60 in response to linear sliding movement of handle bracket 52 will cause yoke 68 to be pivoted to and fro about pivot 70 through the driving connection of link 72, thereby operating the circuit breaker 26 between ON and OFF positions in a nearly concentric manner with the pivot of handle 26*a*.

The foregoing arrangement of linearly sliding operator handle bracket 52 with handle 54 projecting forwardly perpendicularly to the movement of bracket 52 and pivoted drive lever 60 hinged to bracket 52 by pin 64 provides several advantages. The pivoted drive lever 60 provides a preferred arcuate movement for actuating the circuit interrupting apparatus. The linear movement and directly forward attitude of the handle 54 and bracket 52 provide a lower position for the handle 54 when in its uppermost position than would be for a pivoted handle formed as an extension of the pivoted drive lever 60. This feature is particularly significant for control units mounted in the uppermost compartment wherein the handle height from the floor is controlled by industry regulations. Another advantage of the linearly movable, direct forward extending handle is that its forwardmost projection is constant throughout its travel, and is therefore also the minimum forward extension, as opposed to a pivoted handle wherein the minimum forward extension occurs in either the upper or lower positions, but a maximum forward extension occurs when the handle projects directly forward of its pivot. Inasmuch as the edge of openings 4a–12a of doors 4–12 must clear the handle in all positions when the door is swung open, the narrowest of door openings can be achieved with the linear handle movement of this invention. The advantage of this feature is that the housing 38 for the operator mechanism 36 can be made narrower, and still fill the opening 4a–12a for sealing purposes, while minimizing any restriction to access of the panel 18 by the housing 38.

Figure 6:
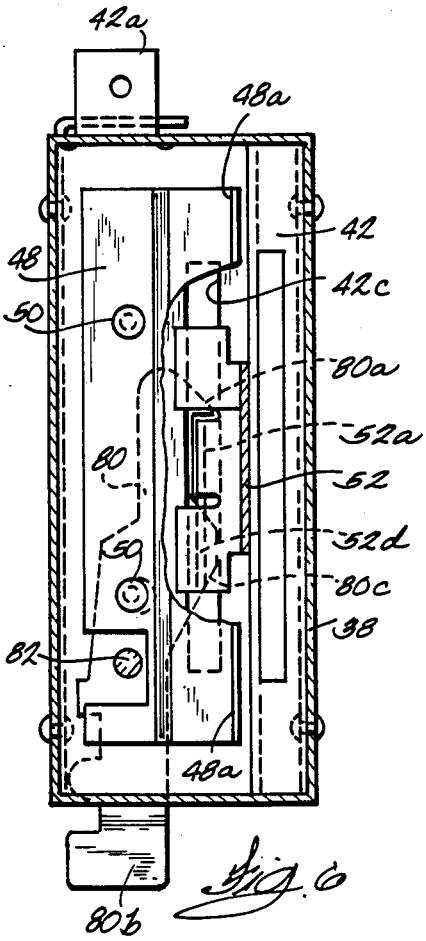
FIG. 6 is a cross-sectional view of the auxiliary operator mechanism of this invention taken along the line 6—6 in FIG. 5.
Figure 9:
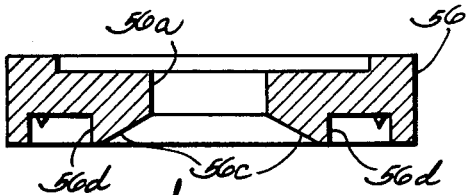
FIG. 9 is transverse cross-sectional view of the cover taken along line 9—9 in FIG. 3.
Figure 10:
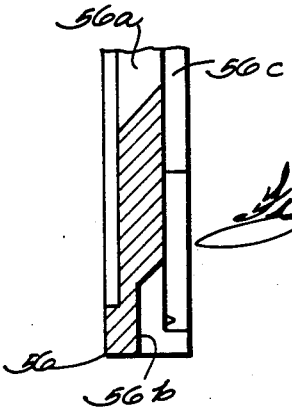
FIG. 10 is a cross-sectional view of the lower end of the cover showing a drainage passageway, taken along the line 10—10 in FIG. 3.

A door interlock lever 80 is pivotally mounted at the lower side of support plate 42 by a shouldered pin 82 which is journaled for rotation in housing 38 and support plate 42. The rearward end of pin 82 is keyed to lever 80 to be nonrotatable with respect to the lever. The forward end of pin 82 is exposed to the front face of housing 38 and has a screwdriver slot formed therein whereby the lever 80 may be rotated counterclockwise as viewed in FIG. 6 by inserting a screwdriver into the slot at the end of pin 82 and rotating the same. Although not specifically shown, the interlock lever 80 is spring biased clockwise as viewed in FIG. 6, wherein handle bracket 52 is shown in an intermediate OFF position, displaced a small amount toward the ON position. Interlock lever 80 is provided with a hook 80a (FIG. 6) at the end thereof adjacent handle bracket drive leg 52a. In a manner well known in the art and not specifically illustrated in the drawings, interlock lever 80 is normally held rotated counterclockwise an amount sufficient to hold hook 80a out of the path of drive leg 52a by engagement of a hook type bracket carried by the respective cabinet door 4–12 (when closed) with a tab 80b of interlock lever 80 protruding beyond the lower end of operating housing 38. This engagement of tab 80b with the hook type bracket also prevents the cabinet door from being opened when the handle is in the position illustrated in FIG. 6 or is moved fully to the ON position. Interlock lever 80 is also provided with a cam 80c spaced below hook 80a. When handle bracket 52 is moved downwardly to an OFF position, drive leg 52a engages cam 80c to rotate interlock lever 80 counterclockwise an amount sufficient to disengage tab 80b from the hook type bracket on the cabinet door, thereby permitting the door to be opened. When the door is open, movement of the handle bracket 52 from a lower OFF position corresponding to an OFF condition of circuit breaker 26 to an upper ON position corresponding to the ON position of circuit breaker 26 will be arrested in the position shown in FIG. 6 by an engagement of the hook 80a with the leading edge of drive leg 52a due to the clockwise bias on interlock lever 80. Accordingly, the circuit interrupting apparatus 26 is prevented from being operated to an ON condition while the cabinet door is open. However, in a manner well known in the art, this handle to door interlock may be defeated by a person knowledgeable in the operation of such devices by manually rotating lever 80 counterclockwise either by engaging pin 82 with a screwdriver or by pushing the tab 80b to the right as seen in FIG. 6.

Operator mechanism 36 is provided with a second interlock for preventing insertion or removal of the removable control unit 16 from a compartment of the cabinet while the circuit interrupting apparatus 26 is in the ON condition. To this end, support bracket 42 is provided with a rearward extension 42d which has its upper and lower ends formed over at right angles to provide end walls 42e and 42f as shown in FIG. 4. Each of the end walls 42e and 42f is provided with a slot for receiving and guiding a slide bar 84 for reciprocal movement therein. Slide bar 84 has a central opening having a tang 84a at one end thereof serving as a spring seat for retaining one end of a helical compression spring 86. The other end of helical compression spring 86 engages an inner surface of end wall 42f, thereby biasing the slide bar 84 outwardly as viewed in FIG. 4. Channel member 22 of the removable control unit 16 is provided with an opening 22a through which the upper end of slide bar 84 projects. Channel 22 is also provided with similar openings 22b and 22c at different locations along the length thereof to accommodate mounting of the operator mechanism 36 at different locations as may be required for different types of circuit interrupting apparatus which may be utilized in the motor control unit. A hexagonal post 88 is attached to the lower end of slide bar 84 by a screw 90 (FIG. 5), the position of post 88 along the length of slide bar 84 being adjustable within a slot 84b. Post 88 is engaged by a lower end of a foot-like extension 52d (FIG. 4) of drive leg 52a when the operator bracket 52 is moved downwardly to the OFF position, thereby driving the slide bar 84 downwardly. When in the extended, or spring biased upward position, slide bar 84 engages a fixed structural member 92 of the motor control center cabinet. Member 92 has a forward depending flange 92a and slide bar 84 is disposed to the rear side of that flange when the unit 16 is inserted into the compartment. In this position slide bar 84 prevents withdrawal of the motor control unit 16 through the open front of the cabinet. Moving the operator handle to the lower or OFF position brings foot 52d into engagement with post 88 to drive slide bar 84 downwardly such that the upper end thereof is clear of the depending flange 92a to enable the control unit 16 to be withdrawn from the cabinet. Slide bar 84 also prevents insertion of unit 16 into a compartment when the circuit breaker is in the ON condition by interferring with the front edge of flange 92a.

Figure 14:
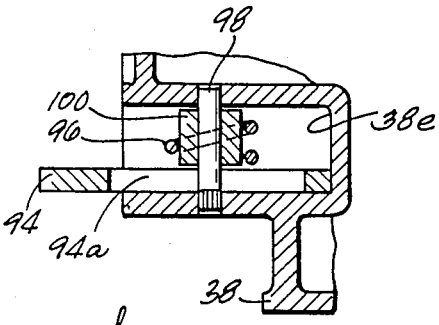
FIG. 14 is a cross-sectional view of the locking plate and operator housing taken along the line 14—14 in FIG. 11.

The operator mechanism 36 is also provided with a handle locking plate 94 which is received in a recess 38e formed in the front surface of housing 38. As seen best in FIGS. 3 and 14, the recess 38e is wider near the vertical center to accommodate a torsion spring 96. A pin 98 is pressed into a pair of aligned holes in the housing 38 to extend across the recess 38e and through an opening 94a in plate 94. A spacer sleeve 100 is also disposed over the pin 98 and torsion spring 96 is positioned around the spacer sleeve 100. Although not specifically shown in the drawing, an abutment is provided in recess 38e against which the horizontal leg of torsion spring 96 is positioned. The vertical leg of spring 96 bears upon a boss 94b (FIGS. 11–13) of locking plate 94. Locking plate 94 also has an elongated opening 94c which is contiguous with the opening 94a, the opening 94c being sufficiently large to accommodate the shackles of three padlocks. Housing 38 has an upstanding rib 38r formed at one side of recess 38e in juxtaposition with the opening 94c to prevent any locking device from being inserted through the opening when the locking plate is in the retracted position. Locking plate 94 has a projection 94d at the end of an upper arm which cooperates with an internal corner 38f of recess 38e to serve as a first pivot for plate 94. A corner 94e at the opposite end of plate 94 cooperates with an internal corner 38g of recess 38e to function as a second pivot for plate 94. The upper arm of plate 94 is also provided with a breakaway tab 94f which projects outwardly of the recess in vertical alignment with the outer edge of plate 94. A second breakaway tab 94*g* extends from the lower end of plate 94.

Figure 11:
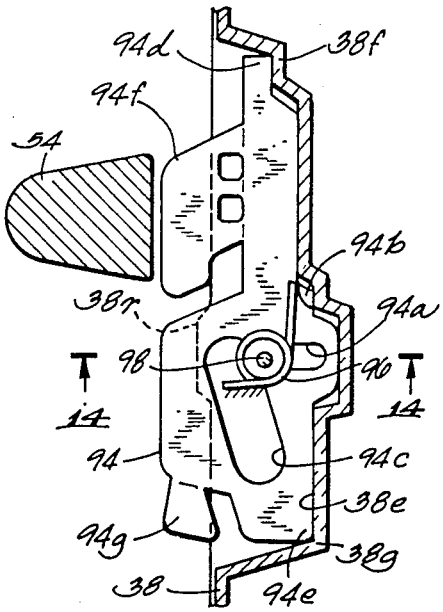
FIG. 11 is a cross-sectional view of a locking plate of the auxiliary operator mechanism of this invention taken along the line 11—11 in FIG. 3, showing the locking plate in a retracted position.
Figure 12:
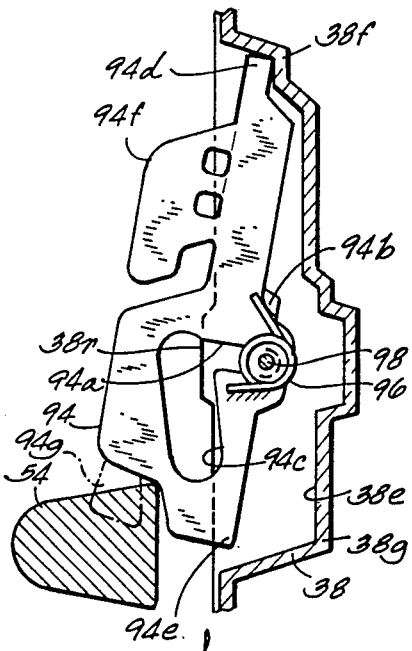
FIG. 12 is a view similar to FIG. 11 but showing the locking plate displaced to an interfering position with the operator handle permitting the latter to be locked in the OFF position.

As can be seen in FIG. 11, the plate 94 is biased to a normal retracted position within recess 38*e* by the spring 96. In this position, the outer edges of locking plate 94 and its breakaway tab 94*f* are retracted out of the path of knob 54 of the operator handle bracket 52 and provide no interference therewith. When the operator handle bracket 52 is in the upper or ON position, and the tab 94*f* is in place, it can be seen from FIG. 7 that locking plate 94 is precluded from being pivotally moved outwardly of the recess either about the first pivot 94*d*, 38*f* or about the second pivot 94*e*, 38*g* because the outer edge of tab 94*f* will abut the handle knob 54. When the operator handle bracket 52 is moved to the OFF position as shown in FIG. 12, the plate 94 may be rotatably moved outwardly about the first pivot 94*d*, 38*f* to move into the path of knob 54. The breakaway tab 94*g* is provided on plate 94 to be operative when the operator mechanism is utilized with a fusible disconnect switch or the like having a longer handle throw in the OFF position. However, when used with circuit breaker 26 such as illustrated herein, the OFF position of handle bracket 52 does not extend as low as for the aforementioned disconnect switch and therefore tab 94*g* may be removed from locking plate 94 at the factory. As seen in FIG. 12, plate 94 is swung outwardly about the pivot 94*d*, 38*f* such that an interior corner along the lower edge of plate 94 engages and cradles the upper rear corner of handle knob 54 to interfere with upward movement of the handle. In this position of locking plate 94, the opening 94*c* is exposed out of the recess 38*e* and may receive up to three padlock shackles for preventing the plate 94 from retracting into the recess 38*e*, thereby locking the handle in the OFF position.

Figure 13:
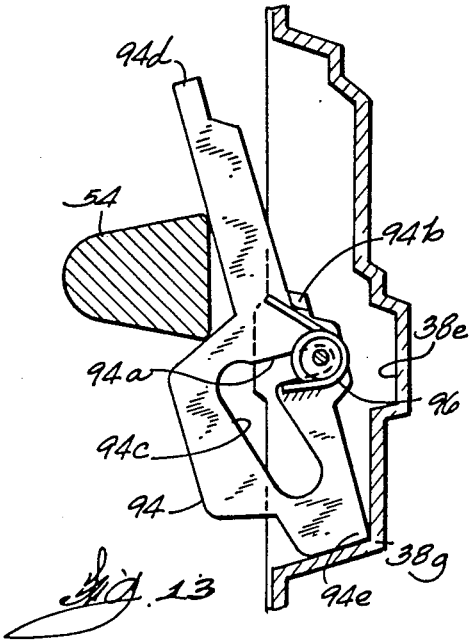
FIG. 13 a view similar to FIG. 11 but showing the locking plate displaced to an interfering position with the operator handle for permitting the latter to be locked in the ON position.

Referring now to FIG. 13, it is occasionally desirable to lock the handle in an ON position. To accomplish this, breakaway tab 94*f* is removed to enable the locking plate 94 to be pivotally moved outwardly of the recess 38*e* about the second pivot 94*e*, 38*g* such thât the upper arm and a main body portion of plate 94 engage and cradle the rear corners of handle knob 54 to lock the same in the ON position. When so rotated, a sufficient amount of opening 94*c* is exposed beyond the outer surface of housing 38 to permit a padlock shackle to be received through the hole 94*c* for locking the plate in this position. The locking plate 94 may also be rotated about the first pivot 94*d*, 38*f* to the position shown in FIG. 12 when tab 94*f* is broken away and handle knob 54 is in the ON position shown in FIG. 11 to provide an alternaive position for looking the handle in the ON position. When this alternative position is used, up to three padlocks may be utilized in the locking opening 94*c* to maintain the lever 94 in position.

The foregoing describes an exemplary preferred embodiment of an auxiliary operator mechanism for circuit interrupting apparatus of a motor control center or the like. the operator mechanism has a linearly slidable handle hinged to a pivoted drive lever for operating the circuit interruptor apparatus, the distance traveled or throw of the operator handle being less than if the handle were an extension of the pivoted drive lever. A locking plate for the operator handle is pivotally movable from a retracted position to lock the handle in the OFF position and may be modified to permit locking the handle in the ON position. Although the auxiliary operator mechanism of this invention has been shown and described in a single preferred embodiment it is susceptible of various modifications without department from the scope of the appended claims.

We claim:

1. An auxiliary operator mechanism for circuit interrupting apparatus, which apparatus is mounted on a removable control unit received within a compartment of a motor control center enclosure and has its own operator means for actuating said apparatus, said auxiliary operator mechanism comprising;

a housing assembly mounted on said control unit accessible to an exterior front surface of said enclosure, said housing assembly having an elongated slot therein communicating between the interior and exterior of said enclosure;

a slide member disposed within said housing assembly, means on said housing assembly mounting said slide for linear reciprocal movement in the direction of elongation of said slot, said slide having a handle fixed relation to said slide, said handle projecting exteriorly of said housing assembly through said slot perpendicularly to said linear movement;

a lever member pivotally mounted on said control unit within said enclosure;

means for coupling said slide to said lever for pivotally driving said lever in response to linear movement of said slide; and means linking said lever to said apparatus operator means for actuating said apparatus in response to movement of said slide.

2. The invention defined in claim 1 wherein said means for coupling said members comprises a projection on one of said members extending into an aperture in the other of said members.

3. The invention defined in claim 2 wherein said aperture is elongated perpendicularly to the direction of movement of said other member.

4. The invention defined in claim 2 wherein said means for coupling said members is located at an end of said lever member remote from said pivotal mounting.

5. The invention defined in claim 1 wherein said housing assembly comprises sealing means disposed in said elongated slot and forming a self-closing slit co-extensive with said slot, said handle projecting through said slit and said slit closing around said handle.

6. The invention defined in claim 5 wherein said sealing means comprises a pair of fibrous strips each having a base portion and a plurality of individual fibers extending outwardly from one side of said base portion, said strips being disposed such that the free ends of said fibers of the respective strips intermesh to form said slit.

7. The invention defined in claim 6 wherein said housing assembly comprises a housing escutcheon and a cover, each having an elongated opening therein aligned with the opening of the other when said cover is attached to said escutcheon for forming said slot, said cover and said escutcheon having internal grooves parallel with said elongated openings for receiving said base portions of said strips for positioning said strips along said slot.

8. The invention defined in claim 7 wherein said individual fibers diverge in the outward direction and said cover and said escutcheon have beveled internal surfaces adjacent said elongated openings for restricting the divergence of said fibers.

9. The invention defined in claim 7 wherein said cover has a passageway open to a lower surface of said cover communicating with a lower end of said slot for draining moisture collected by said fibers.

10. The invention defined in claim 1 wherein said motor control center enclosure comprises a cabinet and a door hinged thereto for closing said compartment, and said door comprises an opening aligned with said housing assembly when closed for providing exterior accessibility of said housing means and said handle, said linearly movable handle having a uniform and minimum forward projection enabling said door opening to be narrow without interference by said handle when said door is opened.

11. The invention defined in claim 10 wherein said auxiliary operator mechanism comprises an interlock bar, means on said housing assembly slidably mounting said interlock bar thereto for sliding movement parallel to said linear movement of said slide member, means biasing said interlock bar to an extended position wherein an end of said bar projects beyond said housing assembly and said removable control unit for engagement with a fixed portion of said cabinet for preventing removal of said control unit from said cabinet compartment when said handle is in a position corresponding to an ON condition of said apparatus, and means on said interlock bar engagable by said lever when said handle is moved to a position corresponding to an OFF condition of said apparatus for driving said interlock bar to a retracted position with respect to said fixed cabinet portion.

12. The invention defined in claim 11 wherein said means on said interlock bar is adjustable in the direction of movement of said interlock bar for determining the retracted position of said interlock bar.

13. The invention defined in claim 1 further comprising:

a recess in said housing assembly disposed between ON and OFF positions of said handle corresponding to ON and OFF actuated conditions of said apparatus, respectively; and a locking plate in said recess, pivot means for said locking plate at opposite ends thereof, said locking plate being movable in a first rotational direction about a first one of said pivot means outwardly of said recess for blocking movement of said handle from said OFF position to said ON position, said locking plate being alternatively movable in a second rotational direction about a second one of said pivot means outwardly of said recess for blocking movement of said handle from said ON position to said OFF position, and said locking plate having a hole intermediate opposite ends thereof accessible when said plate is in a respective one of said blocking positions for receiving at least one locking device therein for locking said plate in a respective one of said blocking positions.

14. The invention defined in claim 13 wherein said handle, when in said ON position, blocks movement of said locking plate in each of said first and said second rotational directions.

15. The invention defined in claim 13 wherein said locking plate has a projection at an end thereof having said first pivot means, said projection engaging said handle when the latter is in said ON position said locking plate is attempted to be moved in said first or second rotational directions for preventing outward movement of said locking plate.

16. The invention defined in claim 15 wherein said projection comprises a breakaway tab formed on said locking plate.

17. The invention defined in claim 13 further comprising resilient biasing means for biasing said locking plate to a retracted position within said recess.

18. The invention defined in claim 13 wherein a portion of said hole in said locking plate is disposed outwardly of said recess when said locking plate is in a retracted position within said recess and said housing assembly comprises at least one upstanding rib adjacent said recess in juxtaposition to said portion of said hole for blocking access of a locking device to said outwardly disposed portion of said hole.

19. The invention defined in claim 13 wherein said locking plate comprises a breakaway tab at an end thereof having said second pivot means, said tab abutting said handle in an OFF position for blocking movement thereof when said locking plate is moved in said first rotational direction when said operator mechanism is used in conjunction with a first type of circuit interrupting apparatus, and said tab being removable for causing a portion of said locking plate at which said tab had been mounted for abutting said handle in an OFF position for blocking movement thereof when said operator mechanism is used in conjunction with a second type of circuit interrupting apparatus.

20. An auxiliary operator mechanism for circuit interrupting apparatus housed within an enclosure comprising:

housing means accessible to an exterior front surface of said enclosure, said housing means having an elongated slot therein;

operator handle means movably mounted in said housing means and projecting exteriorly through said slot;

means within said enclosure linking said operator handle means to said circuit interrupting apparatus for actuating the latter to ON and OFF conditions in response to movement of said operator handle means;

a recess in said housing means located in alignment with movement of said operator handle means and between ON and OFF positions of said operator handle corresponding to ON and OFF positions of said apparatus;

a locking plate disposed in said recess for limited outward movement thereof, said locking plate in a retracted position within said recess permitting unobstructed movement of said operator handle means;

fulcrums within said recess adjacent ends of said locking plate and projections on said locking plate at said opposite ends cooperatihg with said fulcrums for providing first and second pivot means for said locking plate, the latter being movable in a first rotational direction about said first pivot means outwardly of said recess for blocking movement of said operator handle means from said OFF position to said ON position, and an aperture in said locking plate accessible when said locking plate is in said outwardly rotated position for receiving a locking device therein for preventing retraction of said locking plate into said recess.

21. The invention defined in claim 20 wherein said outward movement of said locking plate is limited by an opening in said lockihg plate elongated in said outward direction and a pin mounted in said housing means extending through said opening and said recess.

22. The invention defined in claim 20 wherein said locking plate has a tab projecting therefrom abutting said operator handle means when the latter is in said ON position for preventing outward rotational movement of said locking plate about either said first or second pivot means.

23. The invention defined in claim 22 wherein said tab is removable for permitting outward rotational movement of said locking plate about said first or second pivot means when said operator handle means is in said ON position for blocking movement of said operator handle means to said OFF position.

24. The invention defined in claim 23 wherein said locking plate has a second tab projecting from an end thereof adjacent an OFF position of said opetator handle means for abutting said operator handle means when said locking plate is moved in said first rotational direction and said operator handle means is in said OFF position, said second tab being removable for establishing different locking positions of said operator handle means in said OFF position for different types of circuit interrupting apparatus.

25. The invention defined in claim 24 wherein said tabs are breakaway members.

26. The invention defined in claim 20 comprising resilient means biasing said locking plate to said retracted position.

27. The invention defined in claim 20 wherein said housing is provided with at least one upstanding rib adjacent an edge of said recess in juxtaposition to said aperture in said locking plate for blocking access to any portion of said aperture extending out of said recess when said locking plate is in said retracted position.

28. An auxiliary operator mechanism for circuit interrupting apparatus of a motor control center comprising, in combination:

a cabinet having a plurality of forwardly opening compartmments arranged in vertically stacked relation;

a control unit removably received in a respective one of said compartments through said forward opening;

circuit interrupting apparatus mounted on said control unit said apparatus having its own operating means for actuating said apparatus;

a lever pivotally mounted on said control unit and projecting forwardly within said cabinet from said pivotal mounting;

means linking said lever to said apparatus operating means for actuating said apparatus in response to pivotal movement of said lever;

operator means mounted for vertical linear sliding movement at a forward end of said control unit comprising an operator handle projecting forwardly of an exterior front surface of said cabinet and fixedly disposed perpendicularly to said vertical linear sliding movement, said operator means being hinged to said lever within said cabinet forwardly of said pivotal mounting for effecting pivotal movement of said lever in response to sliding movement of said operator means, said operator means establishing a lower vertical height for an uppermost position of said operator handle than would be for a similar position of a handle extending in linear alignment relation from said lever.

* * * * *